US005082264A

United States Patent [19]

Takeno

[11] Patent Number: 5,082,264

[45] Date of Patent: Jan. 21, 1992

[54] GOLF TEE

[76] Inventor: Katsuji Takeno, 15-47, Nagayoshi Deto 6-chome, Hirano-ku, Osaka-shi, Osaka-fu, Japan

[21] Appl. No.: 703,673

[22] Filed: May 21, 1991

[51] Int. Cl.[5] ..... A63B 57/00

[52] U.S. Cl. ..... 273/33

[58] Field of Search ..... 273/33, 202–212

[56] References Cited

U.S. PATENT DOCUMENTS

| | | | |
|---|---|---|---|
| 1,623,782 | 4/1927 | Dent et al. | 273/33 |
| 1,759,657 | 5/1930 | McLeod | 273/33 |
| 1,815,521 | 7/1931 | McLeod | 273/33 |
| 3,954,263 | 5/1976 | Whalen et al. | 273/33 |
| 4,014,541 | 3/1977 | Desmarais | 273/33 |
| 4,951,945 | 8/1990 | Gamble | 273/33 |

*Primary Examiner*—Theatrice Brown

*Attorney, Agent, or Firm*—Birch, Stewart, Kolasch & Birch

[57] ABSTRACT

The golf tee comprising a mixture of a clay and a binder wherein the clay is kibushi clay, and the binder includes $Na_2O$ as principal component, and a resin layer, formed by applying a resin hardened by applying ultraviolet rays thereto, which is weakened by water resin, which is weakened in contact with water such that the resin is formed on the surface of the mixture which is efflorescent. The elasticity of the golf tee increases with the use of kibushi clay and the binder wherein the binder includes $Na_2O$ as principal component, in comparison with the golf tee formed by only clay. The resin layer increases the strength of the golf tee. The resin layer becomes weak in contact with water. The mixture of the kibushi clay and the binder effloresces. The golf tee is difficult to break, because the elasticity of the golf tee is high, in comparison with the golf tee formed by only clay. The strength of the golf tee is high, so that it can be easily penetrated into a tee ground. Even though the golf tee is left penetrated in the tee ground, the resin layer is weakened in contact with water and thereafter, the mixture of the kibushi clay and the binder effloresces. Therefore, the golf tee does not pollute the atmosphere of a golf course nor is caught in a lawn mower.

4 Claims, 1 Drawing Sheet

GOLF TEE

BACKGROUND OF THE INVENTION

1. Filed of the invention

The present invention relates to a golf tee.

2. Description of the Prior Arts

Conventionally, a golf tee is formed, for example, by cutting wood or molding a synthetic resin. Such a golf tee does not effloresce or decay. Therefore, if it is left penetrated in a tee ground or broken and scattered on the tee ground and in the periphery thereof, the tee ground would be polluted. In addition, it would cause a trouble in case it is caught by a lawn mower.

A golf tee formed by molding and drying clay eliminates the above-described disadvantage because it effloresces even if it is left penetrated in the tee ground. Thus, the golf tee made of clay does not pollute the tee ground or is not entangled by the lawn mower.

However, needless to say, the strength of the golf tee formed by molding only clay and drying molded clay is not high. Therefore, it tends to break when a golfer penetrates it into the tee ground. If a golf tee made of only clay is thickly formed to increase its strength, it is heavy and in addition, difficult to penetrate it into the tee ground.

SUMMARY OF THE INVENTION

Accordingly, it is an essential object of the present invention to provide a golf tee which is high in strength and does not pollute the atmosphere of a golf course.

According to the present invnetion, a golf tee comprises a mixture of a clay and a binder wherein the clay is kibushi clay, and the binder includes $Na_2O$ as prinicipal component, and a resin layer, by applying a synthetic resin hardened by applying ultraviolet rays thereto, which becomes weak in contact with water such that the resin is formed on the surface of the mixture of the kibushi clay and the binder which effloresces.

In comparison with the golf tee formed by only clay, the elasticity of the golf tee increases with the use of kibushi clay and the binder wherein the binder includes $Na_2O$ as principal component.

The formation of the resin layer increases the strength of the golf tee. Further, the resin layer is weakened in contact with water and the mixture of the kibushi clay and the binder effloresces.

According to the present invention, the golf tee is difficult to break, as a result of the elasticity of the golf tee increases in comparison with the golf tee formed by only clay, and the golf tee is high in strength with the resin layer hardened by the ultraviolet rays and as such, can be easily penetrated into the tee ground. Further, even if the golf tee is left penetrated in the tee ground, the resin layer is weakened by water and thereafter, the mixture of the kibushi clay and the binder effloresces. Therefore, it does not pollute a golf course and is not caught by a lawn mower.

These objects and other objects, features, aspects and advantages of the present invention will become more apparent from the following detailed description of the embodiment of the present invention when taken in connection with the accompanying drawings.

DESCRIPTION OF THE PREFERRED EMBODIMENTS

Figure 1:
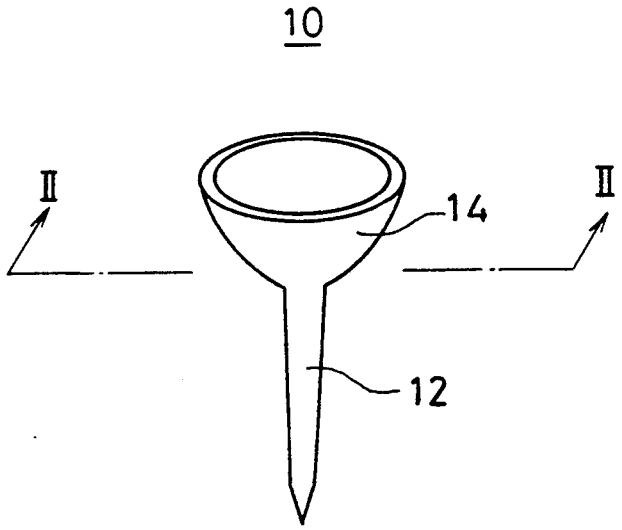
FIG. 1 is a perspective view showing one embodiment of the present invention.
Figure 2:
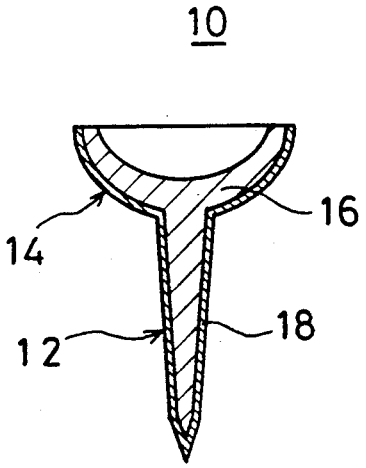
FIG. 2 is a sectional view taken along the lines II—II of FIG. 1.

FIG. 1 is a perspective view showing an embodiment of the present invention and FIG. 2 is a sectional view taken along the lines II—II of FIG. 1. A golf tee (hereinafter referred to as tee) 10 comprises a shaft section 12 which is sharp-pointed and a plate-shaped receiving section 14 for receiving a golf ball. The main component of the tee 10 is principally a mixture 16 of a kibushi clay and a binder. As the material of the binder, for example, it is used of 84.2 wt % of $Na_2O$ powder, 2.8 wt % of CaO powder, 4 wt % of MgO powder, and 9 wt % of $K_2O$ powder. Mixing these powders, adding 3 parts by weight of the mixed powders to 10 parts by weight of water mixing them, and dissolving the powders, thereby, the binder is obtained.

Secondly, kneading 95 wt % of the kibushi clay with 5 wt % of the binder, and the second time kneading them, the mixture is obtained. The kibushi clay is a thing that a plant and a mud is piled up lakes and marshes, the mud turned kaolinization with the influence of a humic acid, and the kibushi clay includes a carbonized wood splinter.

And air contained in the mixture 16 is removed with a vacuum pump therefrom. The removal of air presents the tee 10 from cracking after it is molded. The mixture 16 that removed the air therefrom is drawn out a bar of 11 mm in diameter.

Next, the bar formed with the mixture 16 is pressed using a mold made of plaster. The molded mixture 16 of the bar is hardened using a dryer at approximately 80° C. for about two hours. The reason the mold made of plaster is used is because a tee-shaped molded clay can be easily removed therefrom without using, for example, a mold releasing agent.

A resin layer 18 is formed on the tee-shaped molded clay by applying a synthetic resin hardened by irradiating ultraviolet rays thereto. The material of the resin layer 18 is a mixture of, for example, reactive oligomer, reactive monomer, optical initiator, and an antifoaming agent. The mixture is applied to the surface of the mixture 16 molded and dried. The mixture is irradiated by ultraviolet rays having the wavelength of 200–400 nm. Consequently, the mixture is hardened as a result of the cross-link of molecules thereof. Thus, the resin layer 18 is formed. The resin layer 18 is weakened in contact with water in approximately 24 hours.

When the tee 10 is used, the shaft section 12 thereof is penetrated into a tee ground and a golf ball is placed on the receiving section 14.

In comparison with the golf tee formed by only clay, the elasticity of the tee 10 increases with the use of kibushi clay and the binder wherein the binder includes $Na_2O$ as pricipal component. Therefore, the tee 10 is difficult to break in use it.

The resin layer 18 increases still more the strength of the tee 10. Therefore, the tee 10 is as strong as tees made of wood or a synthetic resin, i.e., the tee 10 is not broken when it is penetrated into the tee ground. Even though the tee 10 is left penetrated in the tee ground, water weakens the resin layer 18 and the clay 16 effloresces.

Accordingly, the tee 10 does not spoil the atmosphere of a golf course. In addition, a lawn mower is not prevented from smoothly working because the tee 10 is not caught therein.

Although the present invention has been described and illustrated in detail, it is clearly understood that the same is by way of illustration and example only and is not to be taken by way of limitation, the spirit and scope of the present invention being limited only by the terms of the appended claims.

What I claim is:

1. A golf tee comprising an elongated shaft having a concaved ball support surface at one end and termmating in a ground penetrating point at its other end, said tee consisting of a material made from a mixture of a clay and a binder wherein said clay is kibushi clay, and said binder includes $Na_2O$ as prinicipal component, and a resin layer, formed by applying a resin hardened by applying ultraviolet rays thereto, which is weakened by water such that said resin layer is formed on said mixture which is efflorescent.

2. A golf tee according to claim 1, wherein said mixture is mixed 95 wt % of said kibushi clay with 5 wt % of said binder.

3. A golf tee according to claim 1, wherein said binder includes CaO, MgO and $K_2O$.

4. A golf tee according to claim 1, wherein air contained in said mixture is removed therefrom.

* * * * *